US005427307A

United States Patent [19]

Campbell

[11] Patent Number: 5,427,307

[45] Date of Patent: Jun. 27, 1995

[54] CARTON AND BLANK THEREFOR HAVING AN IMPROVED TOP PANEL

[75] Inventor: Geoffrey Campbell, Kingswood, United Kingdom

[73] Assignee: Riverwood International Ltd., Bristol, United Kingdom

[21] Appl. No.: 193,177

[22] PCT Filed: Aug. 7, 1992

[86] PCT No.: PCT/GB92/01472

§ 371 Date: May 5, 1994

§ 102(e) Date: May 5, 1994

[87] PCT Pub. No.: WO93/02944

PCT Pub. Date: Feb. 18, 1993

[30] Foreign Application Priority Data

Aug. 9, 1991 [GB] United Kingdom ..... 9117271

[51] Int. Cl.[6] ..... B65D 5/468

[52] U.S. Cl. ..... 229/117.13; 229/117.12; 229/920

[58] Field of Search ..... 229/117.12, 117.13, 229/40, 920; 206/141, 427

[56] References Cited

U.S. PATENT DOCUMENTS

| | | | |
|---|---|---|---|
| 2,681,143 | 6/1954 | Guyer | 206/65 |
| 4,121,757 | 10/1978 | Hamlin | 229/117.13 |
| 4,328,923 | 5/1982 | Graser | 229/33 |
| 4,405,078 | 9/1983 | Dutcher et al. | 229/52 |
| 4,538,759 | 9/1985 | Dutcher | 229/117.13 |
| 4,582,199 | 4/1986 | Schuster | 229/40 |
| 4,712,728 | 12/1987 | Schuster | 229/117.13 |
| 4,838,479 | 6/1989 | Wood | 229/117.13 |

FOREIGN PATENT DOCUMENTS

| | | | |
|---|---|---|---|
| 2274509 | 1/1976 | France | 229/117.13 |

*Primary Examiner*—Gary E. Elkins
*Attorney, Agent, or Firm*—Hopkins & Thomas

[57] ABSTRACT

There is provided a carton 11 for holding a number of articles 34. There is a bottom panel 12, two side walls 13, 14, end panels 17 and overlapping top panels 26, 28. The overlapping portions of panels 26, 28 are glued together and there is a cut-out portion 30 in the outer top panel 26. The cut-out portion 30 lies adjacent the overlapping portions and midway between the carton ends.

16 Claims, 5 Drawing Sheets

FIG. 2
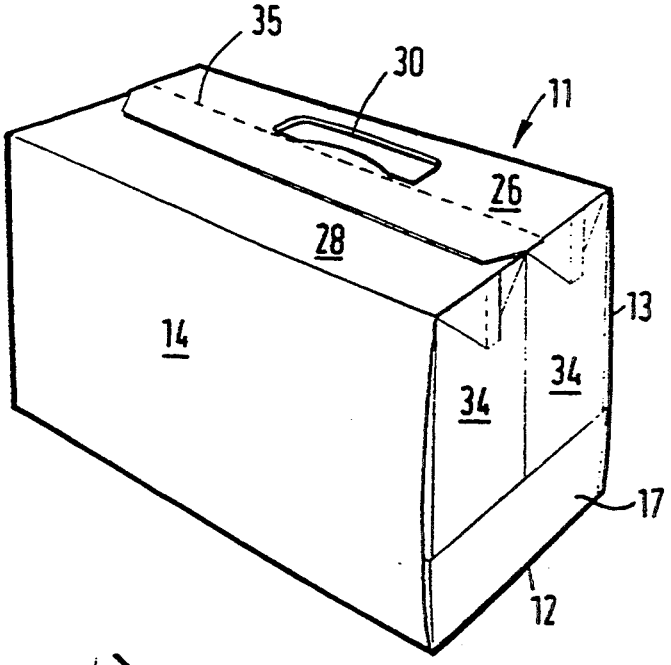
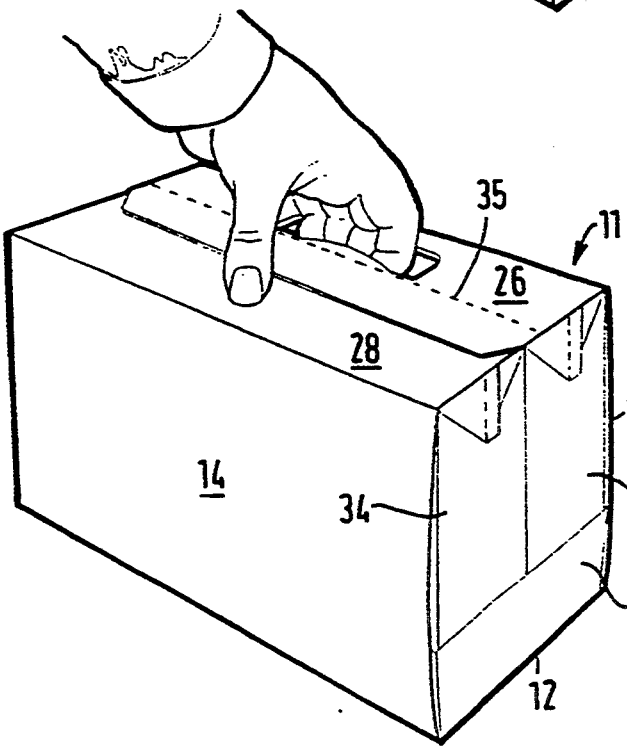
FIG. 3

CARTON AND BLANK THEREFOR HAVING AN IMPROVED TOP PANEL

FIELD OF THE INVENTION

This invention relates to cartons and their blanks.

BACKGROUND OF THE INVENTION

Many products are today sold in cartons which contain more than one article. For example, beverages are sold in multipacks containing any number of parallelipiped containers, cans or bottles. Also, certain bulky items may be wrapped individually in a sleeve-like carton. These cartons not only provide a convenient way of carrying the article or articles contained therein, but they can also provide large, prominent spaces for advertising, promotions or instructions.

SUMMARY OF THE INVENTION

According to a first aspect of the present invention, there is provided a paperboard carton having a bottom panel, two side panels hingedly connected to the respective opposite side edges of the bottom panel and inner and outer top panels hingedly connected to upper edges of the respective side panels, the outer top panel overlaying at least a portion of the inner top panel and being secured thereto and a cut-out being formed in one only of the two top panels so as to constitute handle a.

Preferably the cut-out is made in the outer top panel at a generally central location between its end edges and conveniently the edge of the cut-out nearest the inner top panel is adjacent the edge of the inner top panel.

In a preferred arrangement the cut-out is in the form of a slot for receiving the fingers of a user, so as to support from below the overlayed portions of the top panel. A further preferred feature is that the overlayed, double-thickness portion of the top panel is located generally centrally between the upper edges of the side panels.

Preferably cuts extend slightly towards the free edge of the outer top panel from the two ends of the slot. Conveniently the edge of the slot nearest the free edge of the outer top panel is arcuate and the cuts extend in straight lines from the ends of the arcuate edge. The cuts may extend at an angle relative to the free edge of the outer top panel. In a preferred arrangement, there is a further cut which is spaced from the end of each first cut and which is generally transverse relative to the lengthwise axis of the carton.

In certain arrangements end panels are provided. Preferably the end panels are partial and are hingedly connected to respective opposite ends of the bottom panel. A preferred feature is that tuck flaps are provided for holding the end panels in position, each tuck flap being hingedly connected to its associated end panel and side wall with a score line between the side and end walls.

Ideally the outer and inner top panels are adhesively secured to each other.

Preferably two lines of adhesive are used between the two top panels, one line located adjacent the free edge of the outer top panel and the other line located adjacent the edge of the inner top panel. The other line may extend generally below said further cuts in the outer top panel.

According to a second aspect of the present invention there is provided a paperboard carton blank comprising a bottom panel, two side panels hingedly connected to respective opposite side edges of the bottom panel, an outer top panel hingedly connected to an edge of one side panel opposite the bottom panel and an inner top panel hingedly connected to an edge of the other side panel opposite the bottom panel, a cut-out being made in one only of the top panels.

Preferably end panels are hingedly connected to respective opposite end edges of the bottom panel and each end panel is hingedly connected at its side edges to a pair of tuck panels which are in turn hingedly connected to the respective side panels, a score line being formed in each tuck panel between the side panel and the end panel. It is preferred that each score line is 47° from the adjacent side panel and 43° from the end panel.

Conveniently the hinged connections are formed by fold lines and/or score lines and/or a mixture of both.

Embodiments of the present invention will now be described in more detail. The description makes reference to the accompanying diagrammatic drawings.

BRIEF DESCRIPTION OF THE DRAWINGS

FIG. 2 shows a perspective view of a made-up carton according to the present invention, FIG. 3 shows the carton of FIG. 2 in use.

DETAILED DESCRIPTION

Figure 1:
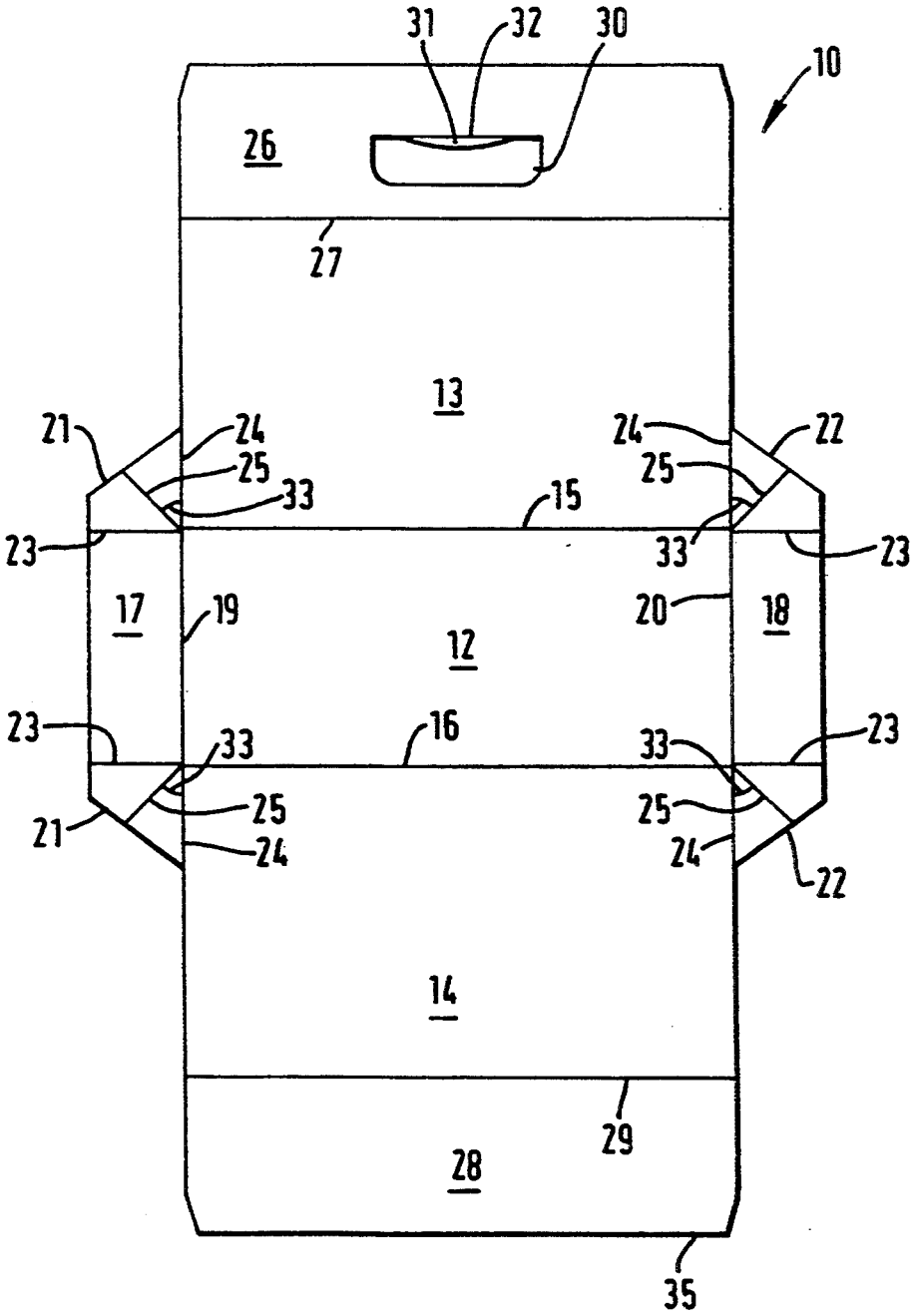
FIG. 1 shows a blank for forming a carton according to the present invention.

Referring to FIG. 1, there is shown a blank 10 pressed from a single sheet of paperboard for a carton 11 which is shown in FIGS. 2 and 3. There is provided a bottom panel 12 which is generally rectangular in shape and is of a size determined by the articles which the carton is to contain. In this illustrated embodiment, the carton 11 is to contain six regular parallelipiped containers of the type which are often used for milk, fruit juices etc, all the faces of which being generally rectangular.

The blank 10 has two side panels 13, 14 hingedly connected to respective side edges of the bottom panel 12 along fold lines 15, 16. Partial end walls 17, 18 are also hingedly connected to respective end edges of the bottom panel 12 along fold lines 19, 20. Tuck flaps 21, 22 connect respective end panels to respective side walls by way of fold lines 23, 24 and reverse fold 25.

There is also provided an outer top panel 26 hingedly connected to side panel 13 along fold line 27 and an inner top panel 28 hingedly connected to side panel 14 along fold line 29. In the outer top panel there is a cut-out portion 30. A small curved lip 31 is, however, retained, hingedly connected to the outer top panel 26 along fold line 32.

In the arrangement shown the angle 33 of each reverse fold 25 relative to the tuck flap side fold 24 is 47° although this is only an example of suitable tuck flap geometry.

To produce the carton 11, the articles 34 are placed in position on the bottom panel 12 and the side panels 13, 14 and end panels are folded upwards towards the articles 34 whilst simultaneously tucking in the tuck flaps between the articles 34 and the side panels 13, 14. The inner top panel 28 is then folded over the top of the articles 34 and one or more lines of adhesive applied to the areas which are to be overlayed by the outer top panel 26. The outer top panel 26 is then folded over the top of the articles 34 and is secured to the inner top panel 28 by virtue of the adhesive.

The geometry of the carton blank 10 is such that the outer top panel 26 overlays the inner top panel 28 by a suitable amount. When the weight distribution of the articles is uniform, as in the illustrated embodiment, the secured portions of the two top panels 26, 28 extend generally centrally along the top of the carton.

The cut-out portion 30 is positioned so that, when the top panels 26, 28 are secured, it lies alongside the edge 35 of the inner top panel 28, which edge 35 is shown in FIGS. 2 and 3 as hidden detail.

The cut-out portion 30 is shaped and sized to allow a user to insert four fingers of one hand and bend the fingers under the overlayed portions of the top panels. Because this overlayed portion is generally central, the carton 11 is well balanced and can, therefore, be easily lifted. The lip 31 can be bent slightly about fold line 32 and around the edge 35 of inner top panel 28 to aid grip and improve comfort. The thumb of the user can also be braced against the carton to improve stability when lifted. Much of the weight of the articles 34 is borne by the central, overlapping portions which are double thickness. Also the inner top panel 28 is not weakened in any way because there are no cut-out portions which tend to produce areas of weakness especially at the corners.

Figure 4:
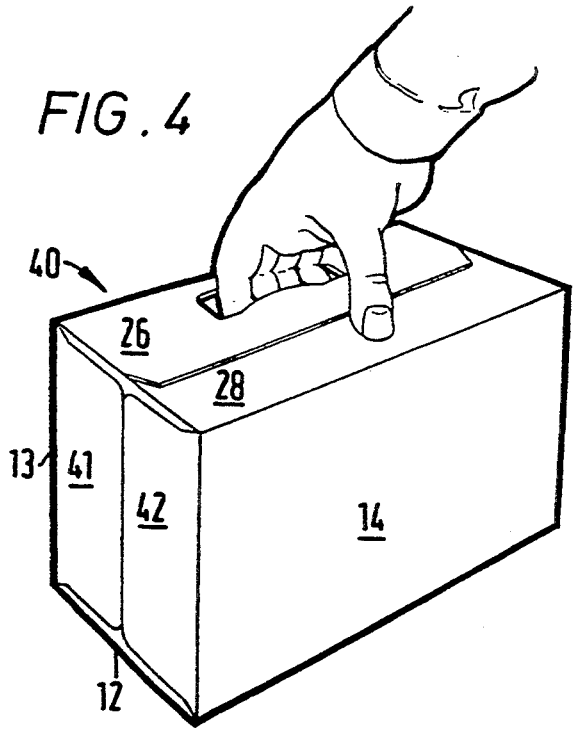
FIG. 4 shows a perspective view of another made-up carton according to the present invention in use.

In FIG. 4 there is shown a similar carton 40 in which like components have been given like reference numerals. In this carton, however, each end is closed with two end flaps 41, 42 hingedly connected to respective side panels 13, 14. These end flaps 41, 42 replace the end panels 17, 18 and tuck flaps 21, 22. This arrangement clearly results in a more closed carton which can of course carry more graphics, advertising or promotions.

In place of the parallelipiped containers the carton could contain cans for say beverages or foodstuffs. The carton could also contain a single item if a carton having a simple, strong carrying means is required.

Figure 5A:
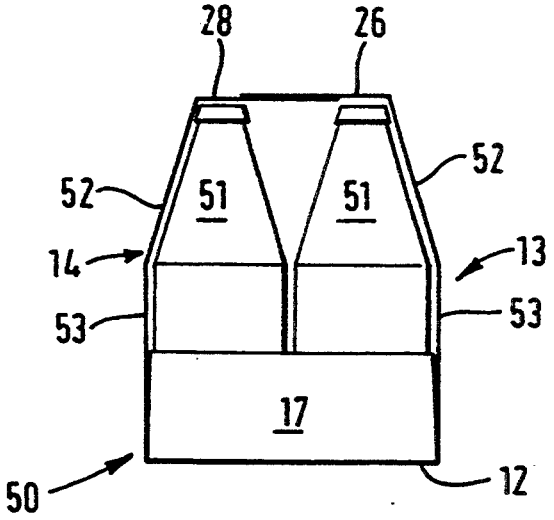
FIG. 5*a* and 5*b* show an end view and a plan view of a further made-up carton according to the present invention.
Figure 5B:
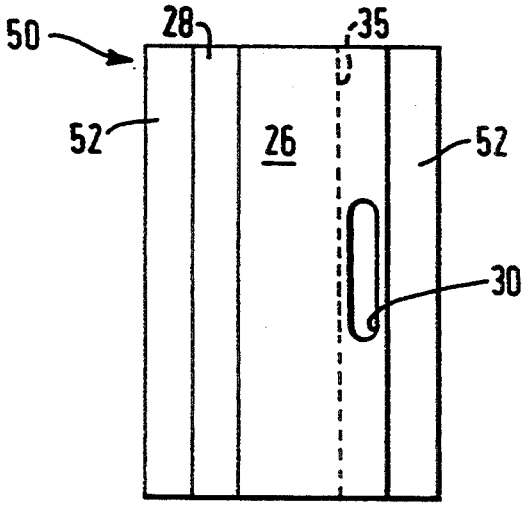

A further example is shown in FIGS. 5*a* and 5*b*. This carton 50 is for carrying bottles 51. Again, it has many similarities with the embodiment shown in FIGS. 1 to 3 and so like components have been given like reference numerals. The principal difference is that each side panel 13, 14 is two-part in form, having an upper section 52 and a lower section 53. This ensures that the carton 50 conforms more accurately to the contours of the bottles 51.

Figure 6:
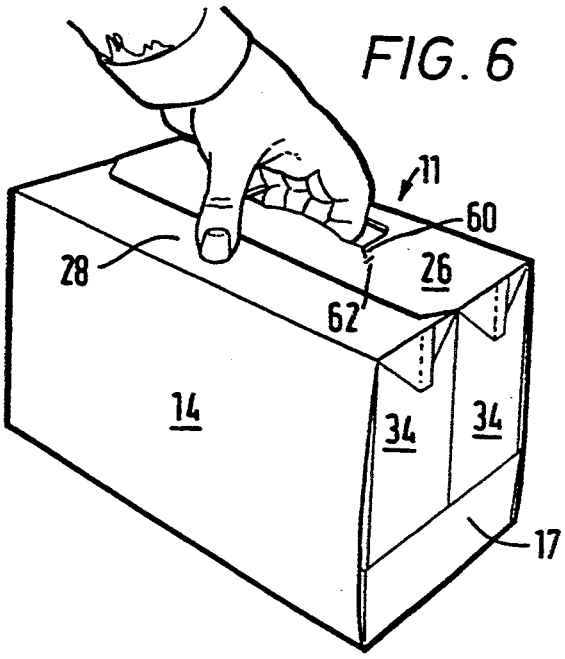
FIG. 6 shows a perspective view of a further made-up carton embodiment in use.

The carton 11 shown in FIG. 6 is very similar to that shown in FIG. 3 and so like reference numerals have been given to like parts. Similarly the blank of FIG. 7 is very similar to that shown in FIG. 1.

Figure 7:
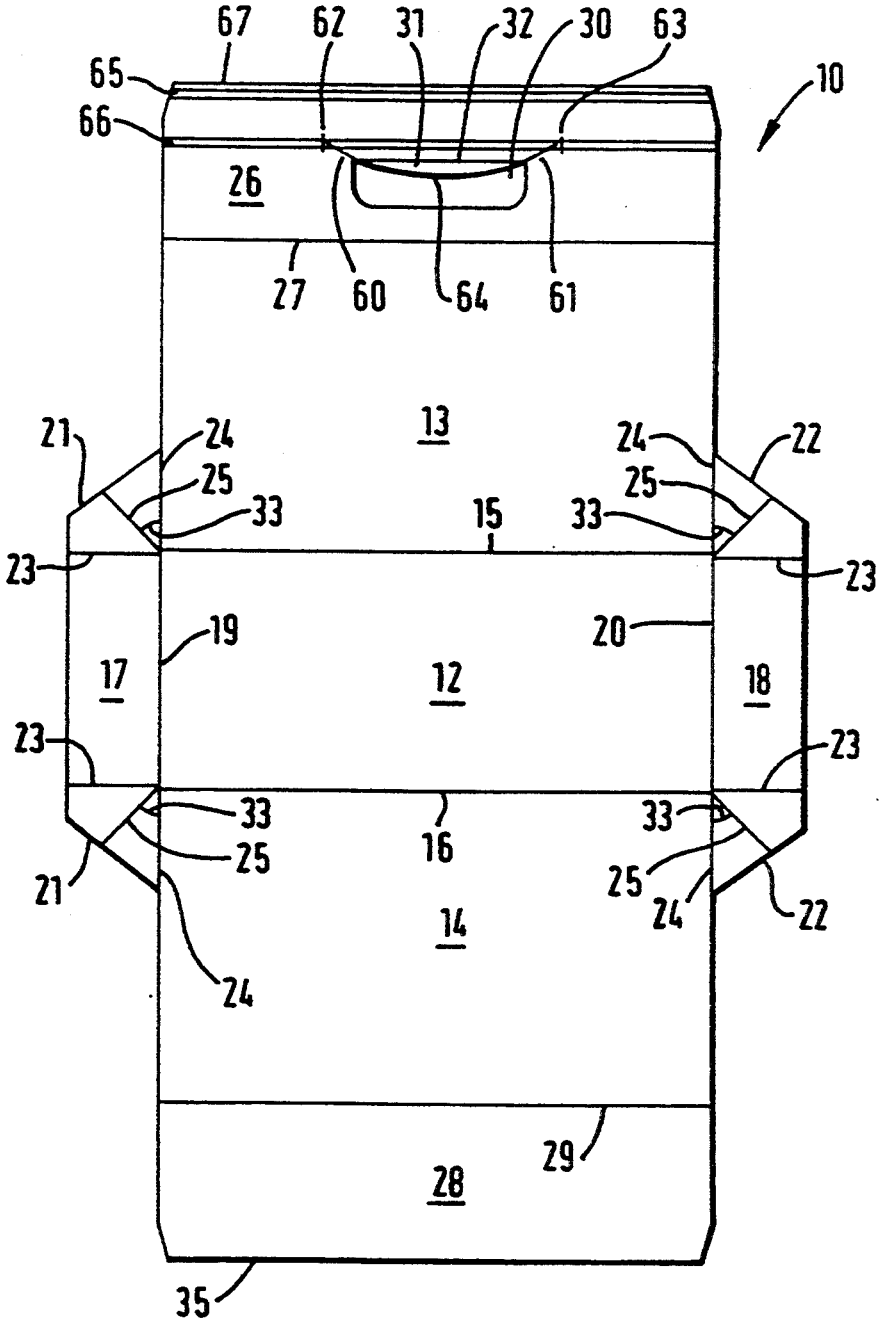
FIG. 7 shows a blank for forming the carton shown in FIG. 6.

A difference is that in the arrangement of FIGS. 6 and 7 there is an angled cut 60, 61 at the ends of the slot 30. Each cut 60, 61 has an associated transverse cut 62, 63 from which it is slightly spaced. Although not essential, the arcuate edge 64 of the slot 30 in this arrangement extends the entire length of the slot 30.

FIG. 7 also shows a preferred adhesive pattern. The adhesive is applied in two lines 65, 66, either on the underside of the outer top panel 26 or on the top side of the inner top panel 28 or indeed a combination. Line 65 is located so as to be adjacent the free edge 67 of the outer top panel 26 and the line 66 is located so as to lie generally below the transverse cuts 62, 63, below the free ends of cuts 60, 61 and at the free edge of the lower top panel 28.

The cuts 62, 63 and 60, 61, together with the adhesive line 66 serve to dissipate the lifting loads over the panel 26 so as to reduce the tendency for the carton to tear at the corners of the slots.

It will be appreciated that any of the fold lines mentioned above could instead be scored lines or part-scored/part-folded. Also, the simple shapes could be made more complex, especially with regard to the end closures. For example, the side panels could incorporate known heel/top receiving apertures for cans or bottles.

It will also be evident that for combining the strength and comfort qualities of the present arrangement the glued, overlapping portions of the top panels should extend centrally of the carton when carrying a uniformly distributed weight. If not uniformly distributed then the portions should pass over the centre of gravity of the loaded carton. The finger receiving slot should be located in one top panel only so that the fingers can extend under the overlapping portions. For best balance the fingers should support above the centre of gravity of the loaded carton.

The term paperboard is intended to cover all forms of card and corrugated/strengthened board.

While a preferred embodiment of the invention has been disclosed in the foregoing specification and drawings, it will be understood by those skilled in the art that variations and modifications thereof can be made without departing from the spirit and scope of the invention, as set forth in the following claims.

I claim:

1. A paperboard carton comprising;

a bottom panel;

two side panels hingedly connected to respective opposite side edges of the bottom panel;

inner and outer top panels hingedly connected to upper edges of respective side panels, the outer top panel overlaying at least a portion of the inner top panel and being secured thereto; and handle means comprising a cut-out formed in only one of the two top panels;

wherein the cutout is made in the outer top panel at a generally central location between end edges of said outer top panel, an edge of the cut-out nearest the inner top panel is adjacent an edge of the inner top panel, the cut-out being in a form of a slot for receiving fingers of a user, so as to support from below portions of the inner and outer top panels which overlap, said portions of the inner and outer top panels which overlap are located generally centrally between the upper edges of the side panels; and wherein first cuts extend slightly towards a free edge of the outer top panel from two ends of the slot.

2. A carton as claimed in claim 1 wherein an edge of the slot nearest the free edge of the outer top panel is arcuate and the first cuts extend in straight lines from ends of said arcuate edge.

3. A carton as claimed in claim 1 wherein the first cuts extend at an angle relative to the free edge of the outer top panel.

4. A carton as claimed in claim 1 wherein second cuts are spaced from one end of the first cuts, said second cuts being generally transverse relative to a lengthwise axis of the carton.

5. A carton as claimed in claim 1 further comprising end panels.

6. A carton as claimed in claim 5 wherein said end panels are partial and are hingedly connected to respective opposite ends of the bottom panel.

7. A carton as claimed in claim 6 further comprising tuck flaps for holding the end panels in position, each tuck flap being hingedly connected to an associated end panel and side wall with a score line between the side and end walls.

8. A carton as claimed in claim 1 wherein the outer and inner top panels are adhesively secured to each other.

9. A carton as claimed in claim 8 wherein two lines of adhesive are used between the two top panels, one line of said two lines being located adjacent a free edge of the outer top panel and a second line of said two lines being located adjacent an edge of the inner top panel.

10. A carton as claimed in claim 9 wherein a line of adhesive extends generally below said second cuts in the outer top panel.

11. A paperboard carton blank comprising:

a bottom panel;

two side panels hingedly connected to respective opposite side edges of the bottom panel;

an outer top panel hingedly connected to an edge of one side panel of said two side panels located opposite the bottom panel; and an inner top panel hingedly connected to an edge of a second side panel of said two side panels located opposite the bottom panel, a cut-out being made in only one of the top panels;

wherein cuts extend slightly towards a free edge of the outer top panel from two ends of said cut-out.

12. A blank as claimed in claim 11 wherein end panels are hingedly connected to respective opposite end edges of the bottom panel, and a pair of tuck panels are hingedly connected to side edges of the end panels, said tuck panels also being hingedly connected to respective side panels, a score line being formed in each tuck panel between a side panel and an end panel.

13. A blank as claimed in claim 12 wherein each score line is 47° from an end panel.

14. A blank as claimed in claim 13 wherein the hinged connections are formed by fold lines.

15. A blank as claimed in claim 13, wherein the hinged connections are formed by score lines.

16. A blank as claimed in claim 13, wherein the hinged connections are formed by fold lines and score lines.

* * * * *